United States Patent [19]

McCabe et al.

[11] 4,031,639

[45] June 28, 1977

[54] SPREADER-FEEDER FOR FLATWORK IRONER

[76] Inventors: Logan D. McCabe, Rte. 4, Box 8, Lubbock, Tex. 79413; Stanley G. McCabe, 5302 11th, No. 146, Lubbock, Tex. 79416

[22] Filed: Oct. 26, 1976

[21] Appl. No.: 735,257

[52] U.S. Cl. ..... 38/143

[51] Int. Cl.[2] ..... D06F 67/04

[58] Field of Search ..... 271/68, 45, 69, 70, 271/84, 85; 38/143, 8, 1; 26/68, 15, 54–57; 34/160, 225; 214/12; 28/1 E

[56] References Cited

UNITED STATES PATENTS

| | | | |
|---|---|---|---|
| 2,585,834 | 2/1952 | Pocock | 38/143 |
| 3,153,291 | 10/1964 | Buss | 38/143 |
| 3,228,127 | 1/1966 | Roiland | 38/143 |
| 3,399,472 | 9/1968 | Evans | 38/143 |
| 3,464,131 | 9/1969 | McCabe | 38/143 |

*Primary Examiner*—G. V. Larkin

*Attorney, Agent, or Firm*—Hill, Gross, Simpson, Van Santen, Steadman, Chiara & Simpson

[57] ABSTRACT

Apparatus for spreading and supplying laundered flatwork to an ironer in a squared condition. The apparatus is carried by a single frame. A central main drive belt and a pincher belt above the main drive belt driven by contact therewith extend along the center of the main frame for a portion of the length of the frame. These belts draw the flatwork as supplied over a semi-ovate spreader apron in advance of the main drive and pincher belt. Upper and lower spreader belts diverging at equal angles with respect to the main drive belt and pincher belt extend along each side of the front portion of the machine and provide a pressure nip in substantially the same vertical plane as the pressure nip between the pincher belt and main drive belt. The upper spreader belt has a rougher surface than the lower one and spins or travels faster than the lower belt and places the laundered article under lateral tension as drawn along the apparatus by the main drive belt and pincher belt and thereby serves to smooth the leading edge of the article. A series of parallel carry-out belts extend parallel to a main drive and pincher belt on opposite sides of these belts from the spreader belts to the discharge end of the apparatus. The speeds of the belts may be varied in accordance with the speed of the ironer. The semi-ovate spreader apron spreads and keeps the laundered article square as fed into the machine.A guard in advance of the spreader apron and at the nip between the main drive belt and pincher belt provides a restricted space into which the article is fed and prevents the pull-in of a misfed article.

29 Claims, 9 Drawing Figures

SPREADER-FEEDER FOR FLATWORK IRONER

FIELD OF THE INVENTION

Spreader-feeder for feeding laundered articles for ironing and other operations such as found in Class 38/143.

PRIOR ART, BACKGROUND, SUMMARY AND ADVANTAGES OF INVENTION

The prior U.S. Pat. to Logan D. McCabe No. 3,464,131 relates to a spreader-feeder for a flatwork ironer including a series of parallel conveyors diverging from each side of a central feeding mechanism including a pair of vertically spaced conveyors extending along the center of the machine for a portion of the length thereof. This spreader-feeder also has parallel belt conveyors extending from the diverging spreader conveyors to the discharge end of the machine and requires air jets to maintain the laundered articles in a spread condition as fed to the ironing machine, all of which require individual motors and generally complicate the machine. The U.S. Pat. to Roiland No. 3,228,127; Buss U.S. Pat. No. 3,153,291 and Pocock U.S. Pat. No. 2,585,834 show forms of spreader-feeders of a relatively complicated construction. While the Buss Patent is of a simpler construction than the aforementioned prior patents, in the apparatus of this patent, the sheet apparently is fed along the top reaches of diverging belts diverging from the entering end of the apparatus. These diverging belts are higher than the spaced carry-away belts and no lateral spreading pressure nip is provided. The sheet is fed over the top reaches of the diverging belts along the top reach of a central driven belt engaged by a top pressure belt, which forms the only feeding apparatus for the laundered articles, and insofar as applicants are aware, has never been an efficient spreader-feeder.

By the apparatus of the present invention, we provide a relatively short machine mounted on a mobile main frame which is so versatile as to feed and spread anything from napkins and table linen to king-size sheets within adjustment. This is attained by a main drive belt extending along the central part of the apparatus for a portion of the length of the apparatus, engaging and driving a pincher belt and by diverging upper and lower vertically aligned spreader belts diverging from the entering end of the main drive belt at equal angles, and providing pressure nips spreading the articles laterally as advanced by the main drive belt, with carry-out belts parallel to the main drive belt and extending from the spreader belts to the carry-out end of the machine in the same horizontal plane as the plane of the pressure nips between the diverging belts and the main drive belt and pincher belt. The top diverging belts and front end of the pincher belt are supported on adjustable stabilizing arms, to enable the pressure nips between the belts to give and to be adjusted. The top diverging belts run at a slightly higher speed than the lower belts to aid in the spreading operation. We further provide a single drive motor driving variable speed gearing that will vary the speeds of the belts from 28 to 200 feet per minute and efficiently drive all of the belts of the apparatus through positive drive connections. A semi-ovate apron is at the entering end of the apparatus for keeping the articles square as fed into the machine and a guard at the entering end of the apparatus prevents the pull-in of a misfed article, all of which features differ from the prior art and are distinct improvements of former spreader-feeders.

The advantages of the present invention are in the simplicity and adaptability of the apparatus to feed-in napkins and table linen as well as sheets up to king-size without adjustment of the apparatus.

A further advantage of the present apparatus over those of the prior art is in the provision of stabilizing arms and the single yoke extending across the apparatus, supporting the diverging entering ends of the top spreader belts and the pincher belt which provide an adjustable pressure control of the nips between these belts and allow for limited vertical movement of the belts.

A further advantage is the provision of a pressure bar extending the width of the machine to hold down articles of varying widths as fed to the ironer.

A still further advantage is in the drive to all of the belts through a single motor, and simplified drive connections from this motor to the belts, in which the top spreader belt is driven at a slightly higher speed than the lower belt to aid in spreading the articles as fed therebetween.

Still another advantage of the invention is the provision of a semi-ovate apron at the entering end of the apparatus for keeping laundered articles square as fed into the machine, together with a guard at the entering end of the main drive belt and pincher belt, preventing the feed-in of misaligned articles.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure.

DESCRIPTION OF PREFERRED EMBODIMENTS OF INVENTION

Figures 1, 4, 6:
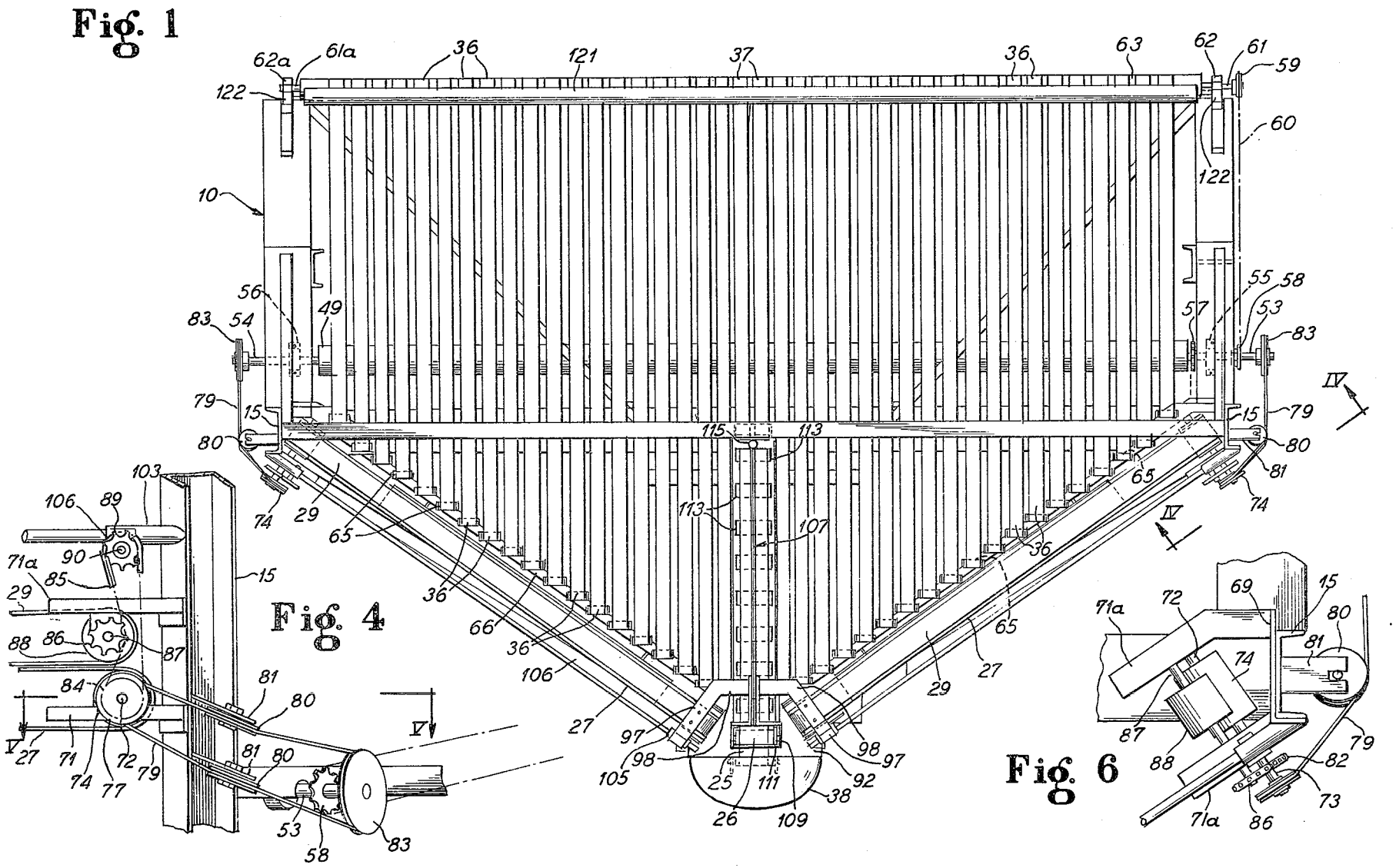
FIG. 1 is a top plan view of a flatwork spreader-feeder constructed in accordance with the principles of the present invention, with certain parts removed.
FIG. 4 is a partial fragmentary view looking at the apparatus substantially along line IV—IV of FIG. 1.
FIG. 6 is a detail view illustrating certain details of the drive to the upper and lower spreader belts not shown in FIG. 5.
Figure 2:
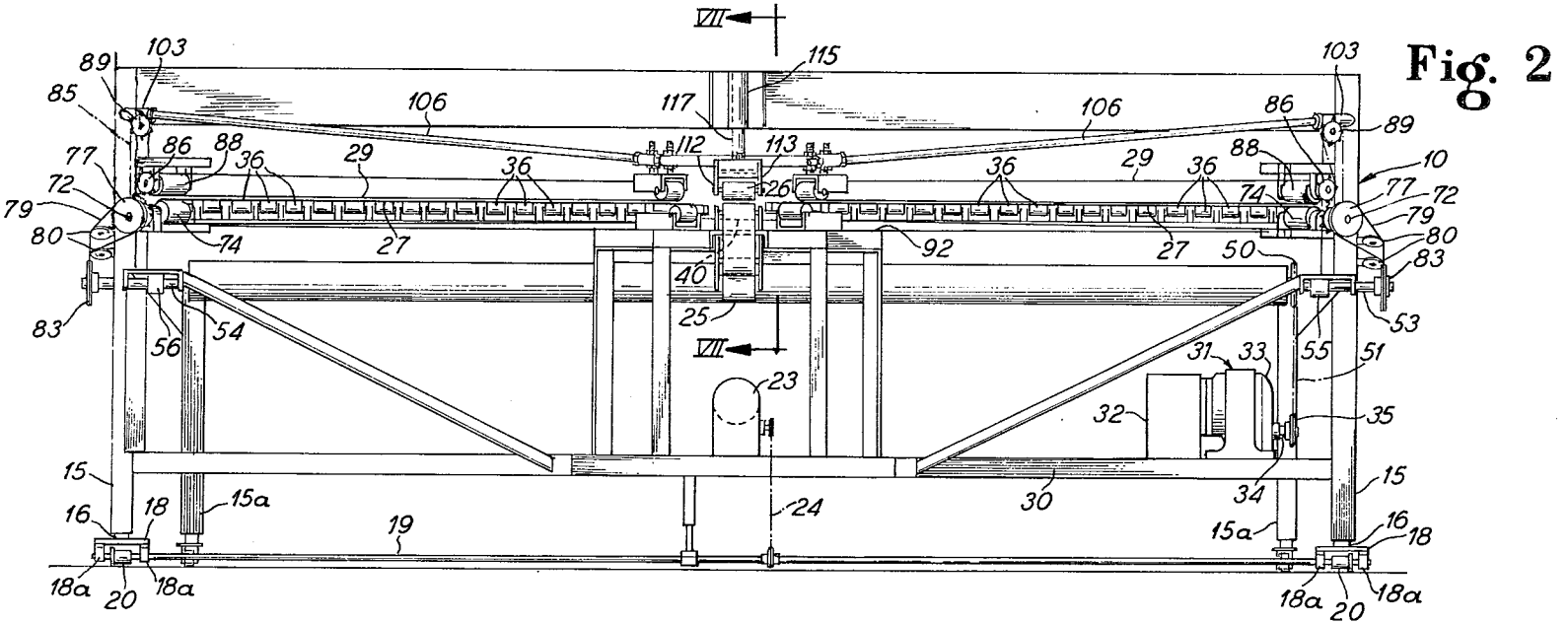
FIG. 2 is a front end view of the apparatus shown in FIG. 1.
Figure 3:
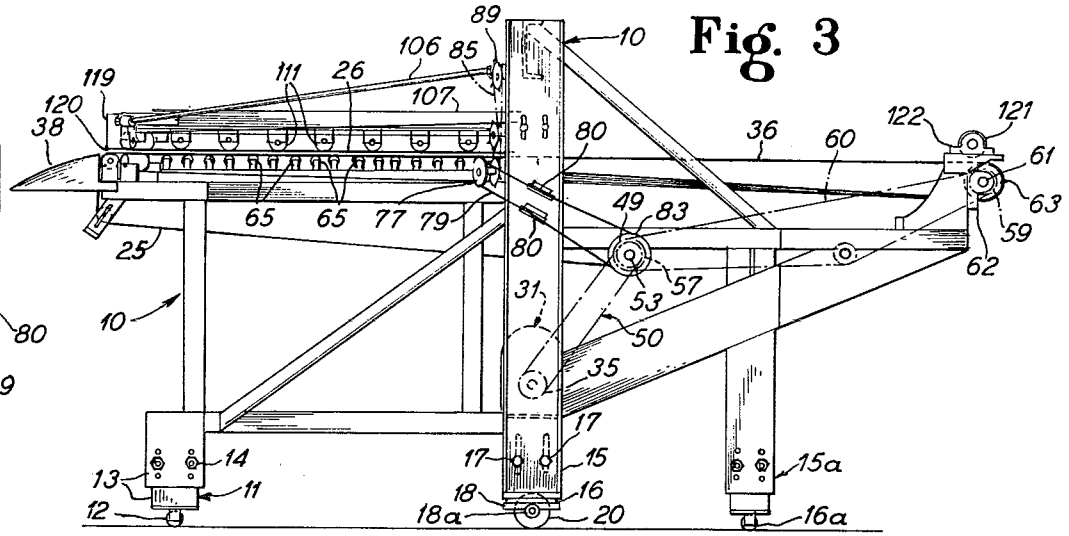
FIG. 3 is a view in side elevation of the apparatus shown in FIGS. 1 and 2 with the semi-ovate spreader apron removed.

In the embodiment of the invention generally illustrated in FIGS. 1, 2 and 3 of the drawings, we have shown a spreader-feeder for laundered flatwork such as sheets, bedspreads, table linen and other articles of flatwork, including a main frame 10 which may be of a welded construction. The main frame is shown as having a central leg 11 at the advance end of the machine, supported on a caster-type wheel 12 at the front end of the machine. The leg 11 is formed from two nested channel members 13 slidably adjustable relative to each other to level the elevation of the front end of the machine and held in position by nuts and bolts 14. The inner channel may have vertically extending slots (not shown) through which the bolts pass to accommodate adjustment thereof. Rearwardly of the central leg 11 are a pair of intermediate legs at opposite sides of the machine in the form of nested slidably adjustable channels 15 and 16 to accommodate leveling of the apparatus and held in adjusted relation with respect to each other, by suitable means, such as nuts and bolts 17. The channels 16 have members 18 extending laterally therefrom in opposite directions and having bearing supports 18*a* thereon forming bearing supports for an elongated transverse drive shaft 19. Wheels 20 are keyed or otherwise secured to said drive shaft between the bearing supports 18*a*, 18*a* and form a means for propelling the apparatus toward or away from an ironing machine. The drive shaft 19 is driven by a speed reducer motor 23 through a chain and sprocket drive 24. The speed reducer motor may be of a conventional construction and may drive the shaft 19 and wheels 20 in a direction to slowly advance the apparatus toward an ironer (not shown), or to retractably move the apparatus as required.

The rear or carry-out end of the main frame 10 is adjustably supported on laterally spaced channel-like nested and telescopic legs 15*a* on caster-type rollers 16*a* in a manner similar to the telescopic support at the front end of the machine for the roller 12. The adjustability of the support affords a means for leveling the machine and also adapting the machine to ironers of various heights. When the machine has been leveled and adjusted for a particular ironer, it need not be readjusted, unless it should be used in a different location for a different type of ironer.

The detailed construction of the particular frame structure and bracing therefor, from the front to the carry-out end of the machine need not be described, except to point out that the channels 15 extend above a central main drive belt 25 and pincher belt 26, and diverging spreader belts 27 and upper spinner belts 29, diverging outwardly from the front ends of said main drive and pincher belts and form a support means for an equalizing support therefor, as will hereinafter be more clearly described.

Supported on a cross frame member 30, which also supports the speed reducer motor 23, and connected between the channels 15 is a variable speed drive motor 31 including a motor 32 having a variable speed drive mechanism 33 connected therewith and forming a part thereof, in which the speed of a drive shaft 34 and sprocket 35 is varied by suitable manual control mechanism to enable the operator of the machine to vary the speed of carry-out belts 36 and main drive belt 25 from 28' to 200' per minute. The sprocket 35 serves as a drive means for all of the belts of the machine as will hereinafter be more clearly described.

The variable speed drive may be of the type made by Sterling Power Systems, Inc., although various other motor-driven variable speed drives may be suitable for use in the drive to the belts.

Figure 7:
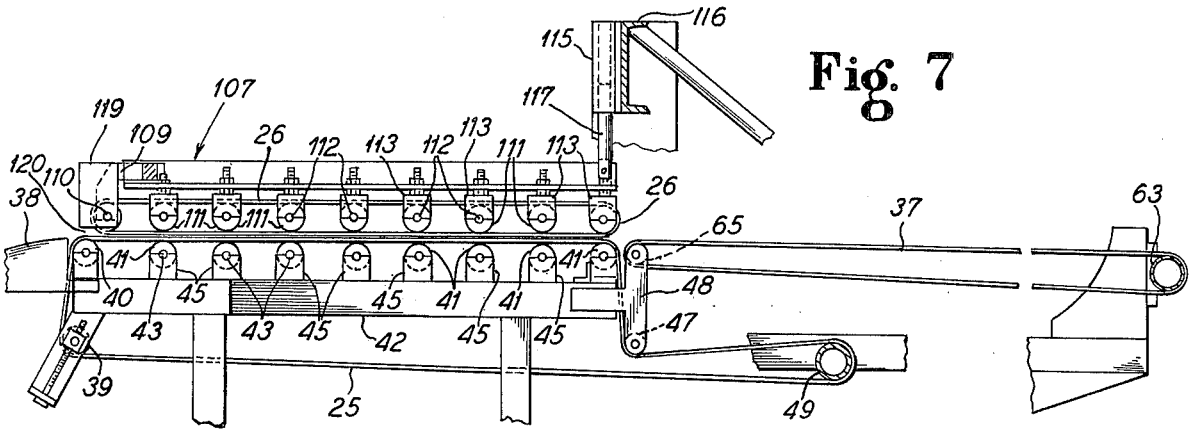
FIG. 7 is a partial fragmentary sectional view taken substantially along line VII—VII of FIG. 2.

The belts of the spreader-feeder, in addition to the central main drive belt 25, the pincher belt 26 and the diverging and spreader belts 27 and spinner belts 29 include the carry-out belts 36 on opposite sides of the main drive and pincher belts. The carry-out belts 36 extend from the angular diverging spreader belts and spinner belts to the carry-out end of the machine. Parallel carry-out belts 37 extend from the main drive belt 25 and pincher belt 26 to the carry-out end of the machine. The carry-out belts 36 are given the same part numbers, even though they are of different lengths. The main drive belt 25, as shown in FIG. 7, extends along the central part of the apparatus from a semi-ovate spreading apron 38 to the central part of the apparatus. The main drive belt 25 is trained upwardly from a tension idler 39 to and about an idler 40 at the entering end of the apparatus and along a series of parallel spaced transversely extending idlers 41 mounted on a main beam 42, extending from the front of the apparatus to the central portion thereof. The idlers 41 are journalled on transverse shafts 43 mounted at their ends on suitable supports 45, suitably supported on the main beam 42. From the front or in-by idler 40, the belt 25 extends to the central portion of the apparatus and downwardly about an idler 47 (FIG. 7) between spaced T-like support members 48 extending rearwardly of the beam 42. From thence the belt extends in a rearward direction about a main drive roller 49 back to the tension idler 39.

Suitable screw-types of adjustment means well-known to those skilled in the art are provided for adjusting the position of the tension idler 39 to take up tension on the belt 25 or to relieve tension therefrom.

The drive to the main drive roller 49 is through a chain and sprocket drive 50 (FIG. 3). The chain of the chain and sprocket drive 50 is trained about and driven by the sprocket 35 of the speed reducer motor 31.

The main drive roller 49 has coaxial shafts 53 and 54 extending from its opposite ends and journalled in bearing boxes or supports 55 and 56 (FIG. 1). The shaft 53 has a sprocket 57 keyed or otherwise secured thereto and forming the driven sprocket of the chain and sprocket drive 50. The shaft 53 also has a drive sprocket 58 keyed or otherwise secured thereto and driving a sprocket 59 through a drive chain 60.

The sprocket 59 is keyed or otherwise secured to a shaft 61 journalled in a bearing support 62 and forming a mounting for a drive roller 63 driving the parallel carry-out belts 36 and 37. The opposite end of the drive roller 63 is supported on a coaxial shaft 61*a* journalled in a bearing support 62*a*. Suitable means (not shown) are provided for adjustably moving the drive roller 63 to take up tension on the belts 36 and 37 and the drive chain 60 for said roller.

As previously mentioned, the forward or in-by ends of the carry-out belts 36 are of different lengths to extend from the spreader and spinner belts 27 and 29 and are trained about idlers 65 suitably mounted on frame members 66 disposed inwardly of and conforming to the angles of the diverging spreader belts 27 and spinner belts 29 disposed above and narrower than said spreader belts.

The carry-outs belts 36 on each side of the main drive belt 25 are trained about idlers 65 at their in-by ends, suitably journalled along the top surfaces of frame members 66 extending generally parallel to the spreader belts 27 and spinner belts 29 and extending from said spreader and spinner belts to the carry-out end of the machine. Each frame member 66 has an outer end portion 67 extending perpendicular to the web of the associated channel 15 and secured to a bracket 69 extending along the inner side or web and forward leg of said channel 15. The supports for the idlers 65 of the carry-out belts on each side of the apparatus may be conventional.

The outer end idler 65 is suitably journalled on the outer end portion 67 abutting and suitably secured at its outer end to the bracket 69. The bracket 69 also has a pair of arms 70 and 71 extending inwardly therefrom parallel to the frame member 66. The arm 70 has a portion conforming to the outer end portion 67 of the frame member 66 terminating into a portion 70*a* perpendicular to the channel 15 and extending to the bracket 69. Both arms extend above the frame members 66 and 67 and form bearing mountings for a drive roller 74 for the spreader belt 27. Similar parallel vertically spaced arms 71*a* form bearing mountings for a drive roller 88 for the spinner belt 29.

The diverging spreader belts and spinner belts disposed thereabove are the same on each side of the apparatus and the drives to said spinner and spreader belts are also the same on each side of the apparatus. The drive to each set of spinner and spreader belts on each side of the apparatus therefore need not be described in detail, except to point out that the V-belt pulley on the left-hand side of the apparatus is coaxial with the shaft 54 and driven therefrom. The same part numbers will therefore be applied to the belt and chain and sprocket drive cn each side of the apparatus.

The arms 70 and 71 of the bracket 69 form supports for bearing supports 73 for a transverse drive shaft 72 for a drive roller 74 for the associated spreader belt 27. Suitable screw-type adjustment means 75 may be provided for the bearing supports 73 to take up tension on the belts 27. The shaft 72 has a V-belt pulley 77 on its outer end driven from a V-belt 79. The upper and lower reaches of the V-belt 79 are trained about vertically spaced V-belt pulleys 80 mounted on the web of the channel member 15 on spaced bearing supports 81 and extend outwardly of said channel member.

Figure 5:
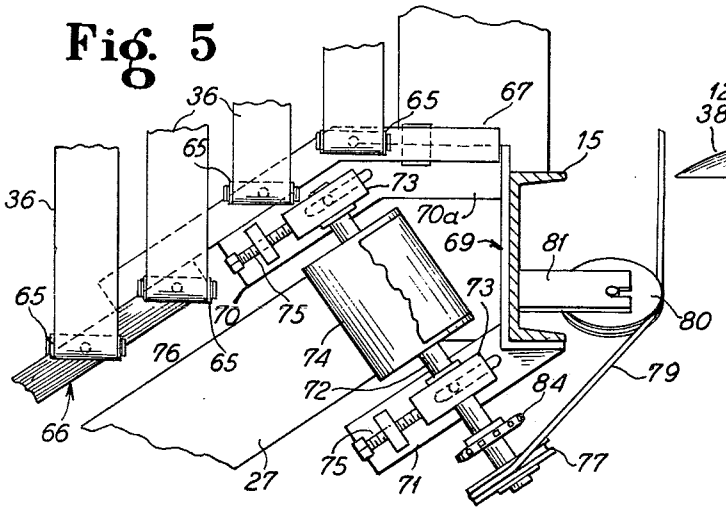
FIG. 5 is a partial fragmentary sectional view taken substantially along line V—V of FIG. 4.

The V-belt 79 is driven from a V-belt pulley 83 keyed or otherwise secured to the outer end of the drive shaft 53 for the drive roller 49, driving the main drive belt 25 (FIGS. 1 and 4). The shaft 72 also has a sprocket 84 keyed or otherwise secured thereto and disposed inwardly of the V-belt pulley 77 (FIG. 5). Said sprocket meshes with a chain 85 meshing with a sprocket 86 on a shaft 87 forming a drive shaft for a pulley 88 for the spinner belt 29 disposed above the spreader belt 27. From the sprocket 86, the chain 85 extends upwardly of the sprocket 86 about a tension maintaining idler sprocket 89 suitably journalled on a shaft 90 disposed above the sprocket 86 and mounted on a bracket 100 depending from a bracket 103. The chain 85 extends downwardly from said sprocket to and around the drive sprocket 84 on the drive shaft 72.

Figure 8:
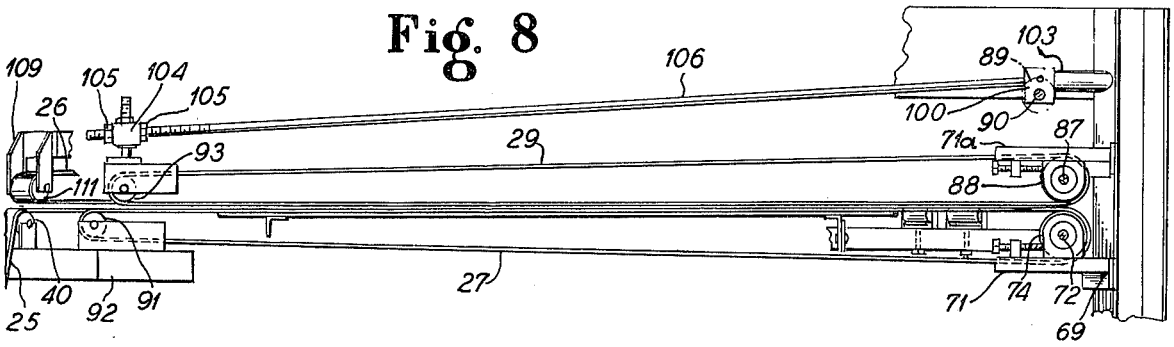
FIG. 8 is a fragmentary side elevational view illustrating the adjustable and equalizing support for the top spreader belt.

A front idler 91 for the spreader belt 27 is journalled on a stationary frame structure 92 of the main frame 10 (FIG. 8). Said frame structure 92 also forms a support for the front idler 40 of the main drive belt 25. The front idler 91 for the spreader belt 27 is shown as extending in advance of a front idler 93 of the spinner belt 29.

The spinner belt 29, as shown in FIGS. 1, 2 and 8, is trained about the drive roller 88 on the shaft 87. Said drive roller is narrower than and of a slightly smaller diameter than the drive roller 74 for the spreader belt 27. The sprocket 84 has more teeth than the sprocket 86 and since the drive roller or pulley 88 is smaller in diameter than the diameter of the drive roller 74 for the spreader belt 27, the spinner belt will travel at a higher rate of speed than the speed of travel of the spreader belt. In the present instance, the spinner belt may travel in the order of five feet per minute faster than the speed of travel of the spreader belt. These differences in speed, however, may be varied in accordance with varying conditions and applicants do not desire to be limited to this particular speed difference.

The spreader belt 27 may be a conventional conveyor belt, such as a canvas and rubber belt, while the spinner belt 29 may be a type of belt termed a Vee top belt made by B. F. Goodrich Rubber Company, and having a rough outer surface to keep the leading edge and hem of the laundered article supplied to the ironer flat and square with the axis of the main drive belt 25 and pincher belt 26 disposed thereabove and driven from said main drive belt.

Each spinner belt 29 and the idler 93 therefor is adjustably supported at its leading end on a support member 97 extending across the front of the belt. The bracket 97 has an angled portion 98 which terminates at its inner end into a transverse support member 99 (FIGS. 1 and 9) extending substantially to the center of the apparatus and abutting and welded or otherwise secured to the support bracket 99 for a front idler 111 for the pincher belt 26.

An equalizing arm 106 is transversely pivoted to a shaft 102 disposed above the shaft 90 for the idler sprocket 89. Said shaft and equalizing arm are mounted on a bifurcated bracket 103 extending from and suitably secured to the adjacent channel member 15 a substantial distance above the spinner belt 29.

The equalizing arm 106 is threaded at its forward end. The forward end of said equalizing arm 106 extends through a sleeve 104, welded or otherwise secured to the outer end of the arm 97 supporting the front end of said spinner belt. Nuts 105 are threaded on the outer end portion of the equalizing arm 106 and abut opposite ends of the sleeve 104 and form an adjusting means for the support bracket 97, for adjusting the elevation of the spinner belt 29 relative to the spreader belt 27. The equalizing support afforded by the equalizing arms 106 at each side of the apparatus may therefore adjust the gap between the spinner and spreader belts. The equalizing support also forms a stabilizing control for the spinner belts and accommodates a certain amount of limited movement of the spinner belt relative to the spreader belt, should there be a tendency to foul the belts by a misfed article of linen.

Figure 9:
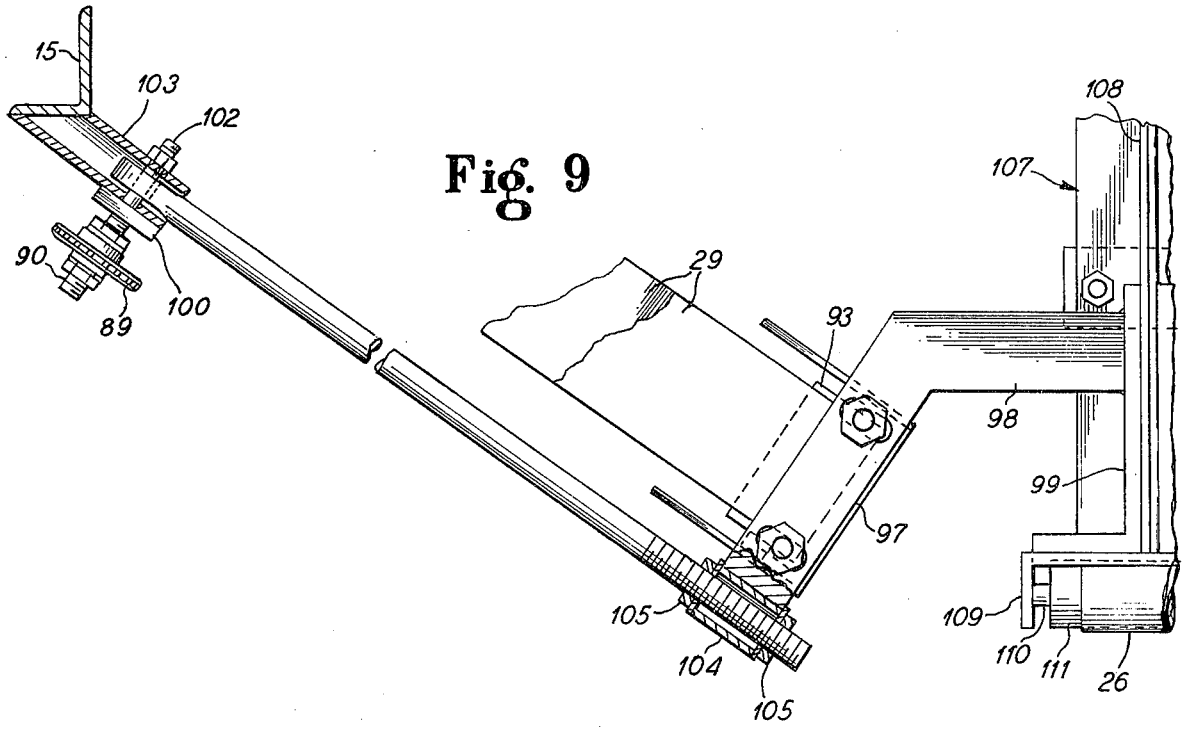
FIG. 9 is an enlarged plan view of the stabilizing support shown in FIG. 8, with certain parts broken away and certain other parts shown in substantially horizontal section.

Referring now in particular to the pincher belt 26 and mounting therefor, a pressure bar 107 extends along the top of said pincher belt 26 and forms a floating mounting for idlers 111 for said belt. Said pressure bar 107 is shown in FIGS. 7 and 9 as being formed from two abutting angles with vertical legs 108 extending upwardly from the horizontal legs of the angles and abutting each other and welded or otherwise secured together. Each support bracket 99 for the front idlers 111 abuts the outer sides of the vertical legs 108 of the pressure bar 107, and is welded or otherwise secured to said vertical legs. Each support bracket 99 has a forwardly extending depending bracket portion 109 forming a support for opposite ends of a shaft 110 for the front or in-by idler 111 and placing said idler at the same elevation as the balance of the idlers 111 for said pincher belt, as shown in FIG. 7.

The rearwardly spaced idlers 111 may be rotatably mounted on transverse shafts 112 supported at their ends in bracket members 113 depending from and mounted on the horizontal legs of the angle irons forming the pressure bar 107 and shown in FIG. 7 as being bolted thereto.

Guide means for the pressure bar 107 and pincher belt 26 is shown in FIG. 7 as being in the form of a cylinder 115 suitably secured to the outer side of the web of a channel 116 connected between the webs of the channel 15. A rod 117 is slidably mounted in the cylinder 115 and transversely pivoted as its lower end to the vertical legs 108 of the pressure bar 107. The pressure bar 107 is thus supported on the equalizing arms 106 at its front end and is free to move up and down at its rear end. The pincher belt 26, suspended from said pressure bar and extending therealong, may thus rest on the main drive belt 25 along the discharge end portion of said pincher belt 26 and be driven from said main drive belt 25 by contact therewith. The space between the main drive belt and pincher belt may be adjusted by adjustment of the equalizing arms 106 by loosening one nut 105 for each equalizing arm and moving the other nut 105 in a tightening direction to elevate the front end portion of the spinner belts and pincher belts or to lower said belts, as conditions require.

A stationary spreader means is shown in FIGS. 1 and 3 as including the spreader apron 38 at the front of the apparatus. Said spreader apron is shown as being of a semi-ovate form and forms a support for the flatwork as fed thereto and keeps the flatwork square as supplied to the machine.

A guard 119 is provided at the front of the pincher belt and extends along opposite sides of said pincher belt and across the forward end thereof to a position closely adjacent the spreader apron 38, and slightly above the advance end of the main drive belt 25. Said guard extends to a position adjacent and above the inner end of the spreader apron 38 and provides a gap 120 between said guard and spreader apron and main drive, through which a laundered article is supplied to the pincher belt, and the diverging spreader and spinner belts. Said guard 119, cooperating with the spreader upon 38 and conveyor belt 25, assures the proper feeding of an article to the main drive belt and pincher belts, as well as to the diverging spreader and spinner belts, and thereby prevents the pulling in of an improperly fed article.

A freely rotatable hold-down roller 121 is provided at the trailing end of the apparatus and is journalled at its opposite ends in bearing supports 122 disposed above the drive roller 63 for the carry-out belts 36 and 37. Said hold-down roller serves to hold down the articles of linen as supplied to the ironer (not shown) by said carry-out belts.

In operating the apparatus, it is first positioned at the ironer by operation of the drive rollers or wheels 20 (FIG. 3) and driven through the chain and sprocket drive 24, driving the transverse shaft 19 from the motor 23. The motor 23 may be controlled to drive the machine in a forward or reverse direction by a suitable switch (not shown), which may be marked "forward" or "reverse" and may be located on the control panel (not shown) of the machine. The machine is then started by pushing a button (not shown) on the control panel marked "start" and as the machine is started and running, a laundered article of linen, such as a sheet, is placed on the ovate spreader apron 38 along the selvage edge, with the hands approximately 18 inches apart from the center of the selvage edge. The sheet is then moved along the ovate spreader apron under the guard 119 through the gap 120 and delivered by the main drive and pincher belts 25 and 26 and spreader and spinner belts 27 and 29, to the carry-out belts 36 of the machine.

As the sheet is delivered by the carry-out belts to the ironer, if it should bunch up, the speed of the ironer may be increased or decreased, it being understood that the feed ribbons (not shown) of the ironer run approximately 1 foot per minute faster than the carry-out belts 36 and 37 of the spreader-feeder. If, however, it should be necessary to change the speed of the ironer, the speed of the feeder must be correspondingly changed to keep the feeder in step with the ironer. During feeding of the sheet, the spinner belts 29, running approximately five feet per minute faster than the spreader belts and having a rough material engaging surface, will keep the leading edge and hem of the sheet perpendicular to the carry-out belts, the main drive belt and pincher belt, and will also spread the sheet as supplied to the ironer and thereby reduce to a minimum the tendency of the sheet to bunch up and also tend to keep the selvage edge and hem straight and thereby take the wrinkles out of the laundered article prior to ironing, to assure a better and more efficient ironing operation.

We claim as our invention:

1. In an apparatus for spreading and feeding flat laundered articles for ironing and like operations, a main frame, a pair of vertically spaced upper and lower power-driven central conveying belts supported on said main frame and extending along the central portion thereof, means supporting the upper of said belts to establish a pressure nip between said belts, spreader means mounted on said main frame on opposite sides of said upper and lower central belts and diverging therefrom as extending therealong, a plurality of equally spaced power-driven carry-out belts extending from said spreader means at opposite sides of said central belts, and extending parallel to said central belts to the discharge end of the apparatus, and providing a substantially continuous article carrying surface for the length of the apparatus, said spreader means including a pair of vertically spaced power-driven belts on each side of said central belts and extending in angular relation with respect to said central belts at equal angles with respect to said central belts, and means maintaining pressure nips between said angularly extending belts for spreading and maintaining the laundered articles square with respect to said central belts as carried along the apparatus by said central belts.

2. The apparatus of claim 1 wherein the upper of said belts diverging from said central belt has a roughened spreader surface.

3. The apparatus of claim 2 including a single motor mounted on said main frame for driving all of said power-driven belts.

4. The apparatus of claim 1 wherein the pressure nips between said central belts, said diverging spreader belts and the material carrying surfaces of said carry-out belts are in substantially the same plane.

5. The apparatus of claim 1 wherein advance spreader means in advance of said central and diverging spreader belts maintains the laundered articles square with the machine as supplied thereinto for spreading.

6. The apparatus of claim 5 wherein a guard extends across the upper of said central belts and provides a gap between said advance spreader means and the lower of said central belts through which the laundered article is supplied to the apparatus, to reduce the pulling in of a misfed article.

7. The apparatus of claim 6 wherein the lower of said central belts forms a main drive belt extending in advance of said diverging spreader belts, and the upper of said vertically spaced central belts is driven by engagement with said main drive belt.

8. The apparatus of claim 7 wherein the upper of said central belts forms a pincher belt for the laundered article and is driven by surface contact between said belts and an article therebetween.

9. The apparatus of claim 8 including a pressure bar forming a support for said pincher belt, guide means for the rear end portion of said pressure bar at the discharge end of said pincher belt, and adjustment means suspending the forward end portions of the upper of said diverging spreader belts and the forward end of said pressure bar, to adjust the pressure between said spreader belts and said pincher belt, and to accommodate limited vertical movement of the upper of said spreader belts and said pincher belt relative to said main drive belt and the lower of said spreader belts at the entering end of the apparatus.

10. The apparatus of claim 9 wherein the support for the forward ends of said pincher belt and diverging belts provides an adjusting means adjusting the pressure exerted by the upper of said spreader belts on the lower of said spreader belts.

11. The apparatus of claim 7 wherein the upper of said spreader belts is narrower than the lower of said spreader belts and is driven at a higher rate of speed than the lower of said spreader belts.

12. The apparatus of claim 11 wherein the upper of said spreader belts has a roughened surface to aid in keeping the leading edge of the laundered article square.

13. The apparatus of claim 12 wherein the advance spreader means comprises a spreader apron of a generally semi-ovate form and extending from in advance of and beneath the central and diverging belts upwardly toward the plane of the pressure nips between said belts.

14. The apparatus of claim 13 wherein a guard extends across and in advance of the forward end of said pincher belt into position closely adjacent the rear end of said spreader apron and the lower of said central conveyor belts, and provides a gap through which the laundered article is supplied.

15. The apparatus of claim 9 wherein the adjustment means for the pressure of the upper of said spreader belts and said pincher belt comprise tie rods pivotally supported on said main frame adjacent the rear ends of said spreader belts, and means adjusting the effective length of said tie rods.

16. The apparatus of claim 9 wherein guide means are provided for said pressure bar guiding said pincher belt at its rear end for free vertical movement relative to the central drive belt therefor.

17. The apparatus of claim 16 wherein the guide means comprises a cylindeer supported on said main frame and a guide rod slidably mounted in said cylinder and pivotally connected to said pressure bar adjacent the rear end thereof.

18. A spreading and feeding apparatus for laundered articles comprising a mobile main frame, diverging vertically spaced spreader belts supported on said main frame and diverging from the entering end thereof and extending from each side of the front central portion thereof, means supporting the upper of said belts for adjustable movement toward the lower of said belts and accommodating a limited amount of movement of the upper of said belts relative to the lower of said belts upon the exertion of upward pressure on the upper of said belts, a main drive belt extending along the central portion of said main frame in advance of and betwen said diverging belts and having an upper run in substantial alignment with the space between said vertically spaced diverging belts, a pincher belt disposed above said main drive belt, a pressure bar supporting said pincher belt, means adjacent the forward end of said pressure bar supporting said pressure bar on said means adjustably supporting the upper of said diverging belts, a plurality of parallel carry-out belts on each side of said main drive belt and pincher belts and extending from said spreader belts to the discharge end of the apparatus, power means for driving said main drive belt including said diverging belts, and spreader means extending across the receiving ends of said spreader belts and said main drive and pincher belts to spread and keep an article square as supplied to said main drive belt, pincher belt and said diverging spreader belts.

19. The spreading and feeding apparatus of claim 18 including guide means for said pressure bar adjacent the discharge end of said pincher belt and comprising a vertically extending guide member supported on said main frame, and a member slidably guided in said guide member and having pivotal connection with said pressure bar, and accommodating the rear end portion of said pincher belt to engage said main drive belt by gravity.

20. The apparatus of claim 19 wherein the drive to said pincher belt is by contact of said pincher belt with said main drive belt.

21. The apparatus of claim 18 comprising a guard cooperating with said spreader means at the receiving ends of said main drive and pincher belts and said diverging spreader belts to prevent the pull-in of a misfed article.

22. The apparatus of claim 21 wherein the guard comprises a guard member extending along opposite sides of and in advance of said pincher belt over said main drive belt and cooperating with said semi-ovate spreader apron and said main drive belt to provide a narrow gap through which the article of linen is supplied.

23. The apparatus of claim 19 wherein the adjustable supports for the upper of said diverging spreader belts and said pincher belt includes tie rods connected with said main frame for pivotal movement with respect thereto transverse to the axes of said diverging spreader belts, adjustment means connecting said tie rods to said diverging spreader belts adjacent the receiving ends thereof and support means from said adjustment means to said pressure bar.

24. The apparatus of claim 18 wherein the upper of said diverging spreader belts is narrower than the lower of said diverging spreader belts and the drive means for driving said belts includes means for driving the upper of said diverging spreader belts at a higher rate of speed than the lower of said diverging spreader belts.

25. The apparatus of claim 24 wherein the drive means for said belts forms a drive for said carry-out belts driving said carry-out belts at the same rate of speed as said main drive belt.

26. The apparatus of claim 25 inlcuding two parallel spaced carry-out belts forming continuations of said main drive belt and extending to the discharge end of the apparatus, and a freely rotatable hold-down roller extending across said carry-out belts adjacent the discharge end of the apparatus and holding down the laundered articles as delivered for further processing.

27. The apparatus of claim 25 wherein the drive means for said belts includes a motor, and variable speed drive gearing driven by said motor operably under the control of the operator of the machine to vary the speeds of all of said belts as required.

28. The apparatus of claim 27 wherein a single drive roller extending across the discharge end of the apparatus beneath said hold-down roller is provided for driving all of said carry-out belts at the same rates of speed.

29. The apparatus of claim 28 including a motor separate from the drive motor for said belts and variable speed drive gearing driven by said drive motor is provided for moving the apparatus toward and from a further processing apparatus for a laundered article.

* * * * *